United States Patent [19]

Aichert et al.

[11] Patent Number: 4,821,791

[45] Date of Patent: Apr. 18, 1989

[54] MELTING FURNACE FOR PRODUCING STRAND-CAST INGOTS IN A PROTECTIVE GAS ATMOSPHERE

[75] Inventors: Hans Aichert, Hanau am Main; Herbert Stephan, Bruchköbel; Hermann Stumpp, Alzenau; Walter Dietrich, Hanau am Main; Michael Kiessling, Langenselbold, all of Fed. Rep. of Germany

[73] Assignee: Leybold Aktiengesellschaft, Hanau am Main, Fed. Rep. of Germany

[21] Appl. No.: 157,910

[22] Filed: Feb. 19, 1988

[30] Foreign Application Priority Data

Nov. 30, 1987 [DE] Fed. Rep. of Germany ..... 3740530

[51] Int. Cl.[4] ..... B22D 11/04; B22D 11/10; B22D 27/15

[52] U.S. Cl. ..... 164/506; 164/256; 164/258; 164/420

[58] Field of Search ..... 164/506, 512, 508, 514, 164/420, 469, 474, 494, 495, 256, 258

[56] References Cited

U.S. PATENT DOCUMENTS

| | | | |
|---|---|---|---|
| Re. 27,945 | 3/1974 | Hunt et al. | 164/506 X |
| 3,237,254 | 3/1966 | Hanks et al. | 164/506 X |
| 3,273,212 | 9/1966 | Garmy et al. | 164/514 X |
| 3,388,903 | 6/1968 | Accary et al. | 164/506 X |
| 3,821,979 | 7/1974 | Paton et al. | 164/506 |
| 4,027,722 | 6/1977 | Hunt | 164/474 X |
| 4,730,661 | 3/1988 | Stephan | 164/506 X |

OTHER PUBLICATIONS

"Elektronenstrahl-Schmelzanlagen N6", 1966, p. 62 of W. C. Heraeus GmbH.

*Primary Examiner*—Nicholas P. Godici
*Assistant Examiner*—J. Reed Batten, Jr.
*Attorney, Agent, or Firm*—Felfe & Lynch

[57] ABSTRACT

Melting furnace (1) for the production of strand-cast ingots (17, 18) in a protective gas atmosphere, has a charging apparatus (8) for feeding starting material (11) into a melting area (14). Within a melting chamber provided with a chamber floor (**2*d*) and at least one energy source (4,5) there is situated a strand-casting mold (15) for the transformation of the melt to an ingot (17, 18) and underneath the strand-casting mold is disposed an offbearing apparatus (25) for offbearing the ingot, and an offbearing chamber enveloping the ingot and the offbearing apparatus. To solve the problem of operating such a melting furnace virtually continuously, the strand-casting mold (15) together with at least one additional strand-casting mold (16) is disposed in the chamber flow (2*d*) in such a manner that each of the strand-casting molds (15, 16) can be brought into the drop path of the melt by a preferably horizontal relative movement. Furthermore, one offbearing apparatus (25, 26) and one offbearing chamber (23, 24) are associated with each strand-casting mold, and at least one vacuum valve (19, 20) is disposed between each strand-casting mold (15, 16) and the offbearing chamber (23, 24) associated with it. Preferably the strand-casting molds (15, 16) are disposed in a chamber floor (2*d***) configured as a turning disk.

16 Claims, 4 Drawing Sheets

Figure 1:
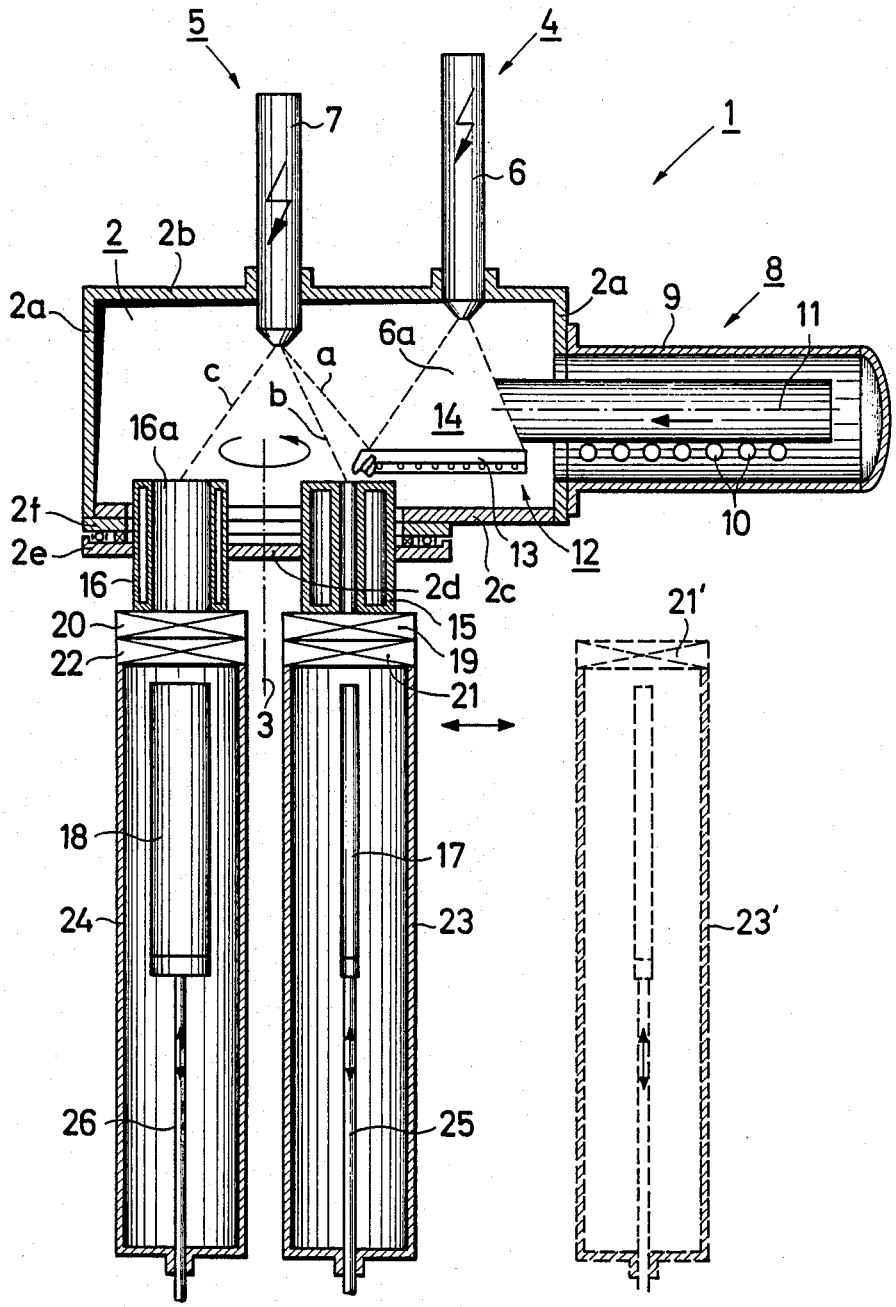

FIG. 4
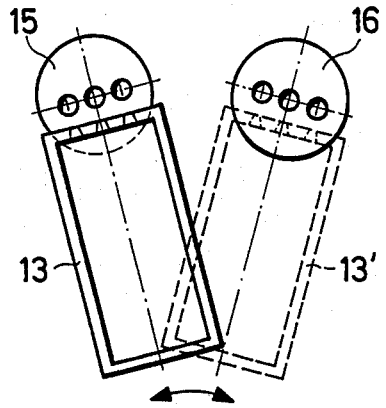
FIG. 2
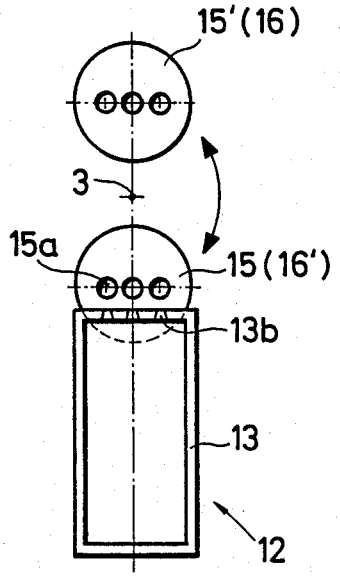
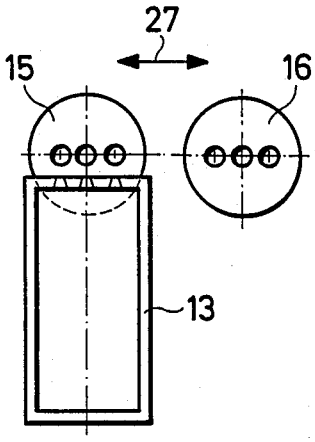
FIG. 3

FIG. 5
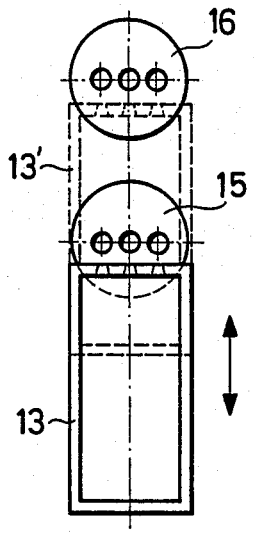
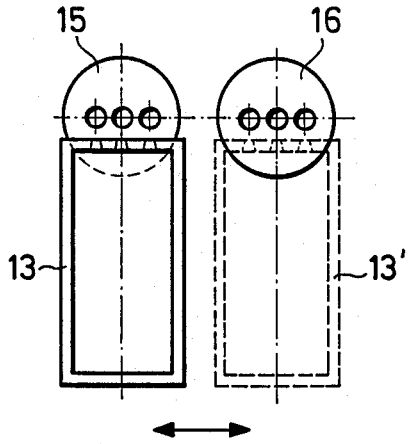
FIG. 6

MELTING FURNACE FOR PRODUCING STRAND-CAST INGOTS IN A PROTECTIVE GAS ATMOSPHERE

The invention relates to a melting furnace for producing strand-cast ingots in a protective gas atmosphere, having a charging system for feeding starting material into a melting zone within a melting chamber provided with a chamber floor, having at least one energy source for melting the starting material, having a strand-casting mold to convert the melt to an ingot, having a system disposed under the strand-casting mold to bear the ingot off, and having an offbearing chamber associated with the strand-casting mold and surrounding the ingot and the offbearing device.

The expression, "protective gas atmosphere," is intended to mean an atmosphere in which a reaction of the material to be melted is prevented. The protective gas atmosphere can be formed by a corresponding depression (vacuum), inert gas, noble gas, or a reducing gas.

A melting furnace of the kind described above is disclosed by the publication, "Elektronenstrahl-Schmelzanlagen N6," 1966, page 62, of W. C. Heraeus GmbH. Underneath the chamber floor, two offbearing chambers rotatable in the manner of a turret are disposed with offbearing devices which can be coupled alternately with a single strand-casting mold disposed in the chamber bottom. The upper ends of the offbearing chambers and the bottom of the strand-casting mold are provided each with a vacuum valve so that the penetration of ambient air into both the melting furnace and into the offbearing chambers can be prevented after an offbearing chamber has been separated from the melting chamber. Also, the charging of the melting chamber with a new consumable electrode is performed by means of one of the offbearing chambers.

Even if the recharging of the known melting furnace were to be performed in some other manner and the two offbearing chambers were to be used alternately for the removal of the finished ingot, there will still be considerable time intervals between the completion of one ingot and the beginning of the melting of the next ingot. It is to be noted that the just-completed ingot must be allowed to cool for a time in the strand-casting mold so that, when the ingot is lowered away, there will no longer by any fluid phase on its upper end. This cooling phase must be further delayed by a low-power heating of the top of the ingot so that no voids or other flaws can form in the top. The cooling time required can easily amount to 15 minutes and more. Also, there is another time interval of 15 minutes duration for the changing of the offbearing chamber and the offbearing device, so that a pause in operation of 30 minutes duration must be added to a total melting time of, again, 30 minutes. The efficiency of time use therefore amounts to about 50%.

In the case of larger ingots and therefore longer melting time of up to 20 hours the efficiency of time use is, of course, automatically increased. But when the demand is for small ingots it has heretofore been necessary to accept a low efficiency.

Furthermore, during the correspondingly long suspension of operations, volatile metals can easily evaporate out of the standing, molten content of a ladle. For example, the chromium content of a superalloy in this manner drops from 19% to 18%, so that the specification for the alloy in question cannot be satisfied.

It is therefore the aim of the invention to improve a melting furnace of the kind described above such that a quasi-continuous manner of operation will be possible.

The solution of the stated problem is accomplished according to the invention, in the melting furnace described above, by the following features:

(a) The strand-casting mold is disposed in the chamber floor with at least one additional strand-casting mold such that each of the molds can be brought into the path of the falling stream of molten metal by a relative movement with respect to the melting area.

(b) Each strand-casting mold is associated with an offbearing chamber which can be coupled hermetically to it and which has an offbearing means for the strand, and (c) Between each strand-casting mold and the offbearing chamber associated with it there is disposed at least one vacuum valve.

The relative movement between the strand-casting molds and the melting area described under (a) above can be achieved in different ways. On the one hand it is possible to push or rotate the strand-casting molds successively into the path of the falling metal. Furthermore, it is possible to dispose a displaceable ladle or swinging spout between stationary strand-casting molds and a stationary melting area, and lastly it is possible also to displace the melting area and associate it successively with the individual strand-casting molds.

By the configuration of the melting furnace according to the invention the interruption of operation is reduced to a duration of about 20 seconds, which in the case of 30 minutes of melting time amounts to a time loss of less than 1%. Also, it is no longer necessary to wait for a cooling period before removing a strand-cast ingot, because the ingot can remain in the strand-casting mold until it has completely solidified after any hot-topping procedure that may follow the casting. Lastly, this also eliminates the impoverishment of alloys through loss of easily volatile elements from a ladle.

An especially advantageous, simple and reliably-operating construction of such a melting furnace will result when, according to the further invention, the chamber floor is gas-tight with respect to the melting chamber and disposed for movement in a horizontal plane relative to the latter, and when the offbearing chamber is horizontally movable with the strand-casting mold while the offbearing chamber is in the connected state.

By such a construction one of the strand-casting molds with the corresponding offbearing device and offbearing chamber can be moved to one side, while at the same time a new strand-casting mold with offbearing device and offbearing chamber can be brought into the path of the falling metal. At the same time it is again especially advantageous for the chamber floor to be in the form of a rotating disk with a vertical axis of rotation.

Additional advantageous developments of the subject matter of the invention will be found in the rest of the subordinate claims; their advantages and manner of operation will be further explained below in the detailed description.

Embodiments of the subject matter of the invention will be further explained hereinbelow in conjunction with FIGS. 1 to 8.

Figure 7:
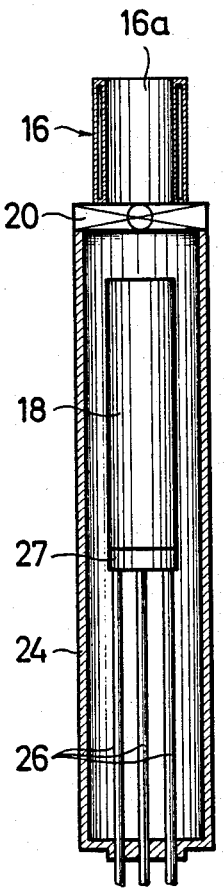
Figure 8:
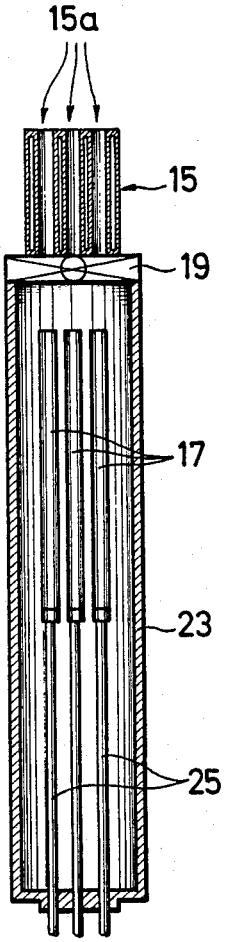

FIG. 1 is a vertical section through a complete melting furnace for vacuum operation using electron beam heating, FIG. 2–6 show various possibilities for feeding the molten metal to the individual strand-casting molds, FIGS. 7 and 8 are vertical sections through the strandcasting molds and the offbearing chamber according to FIG. 1 perpendicular to the plane of drawing in FIG. 1.

In FIG. 1 is shown a melting furnace 1 whose melting chamber 2 has side walls 2*a*, a chamber roof 2*b* and a chamber floor 2*c* to which a chamber bottom 2*d* is attached rotatably and sealingly. This chamber bottom is constructed like a turntable and is rotatable about a vertical axis 3.

Two power sources 4 and 5 are inserted into the chamber roof 2*b* and are in the form of electron beam guns 6 and 7. Such electron beam guns are known in themselves and obtainable on the market. They emit a focused electron beam which by means of an electromagnetic deflecting system, not shown here, can be moved about within an angular area which is indicated by broken lines.

To one of the side walls 2*a* there is attached a charging system 8 which consists of a lock chamber 9 and a system 10 for feeding the starting material. The starting material 11 is in the form of a bar, and the feeding system 10 consists of individually driven transport rollers. By means of the charging system 8 the starting material 11 is brought into the range of the electron beam 6*a* and melted over a melt carrying unit 12 which in the present case is in the form of a water-cooled tundish 13 whose molten content is heated from above by the same electron beam 6*a*. The area struck by the electron beam 6*a* is to be referred to as the melt area 14. The chamber bottom 2*d* is in the form of a circular plate and has at its outer circumference a raised flange 2*e* which cooperates in a vacuum-tight but rotatable manner with a corresponding flange 2*f* on the bottom of the melting chamber 2.

On a diametrical line of the chamber bottom 2*d* there are disposed two strand-casting molds 15 and 16 which in the present case are of different construction but of course can be identical. The strand-casting mold 15 has three cavities 15*a* disposed in a row, which will be further discussed later on in conjunction with FIGS. 2 to 6. The vertical longitudinal axes of these cavities 15*a* lie in a plane perpendicular to the plane of drawing of FIG. 1. With a strand-casting mold 15 of this kind three strand-cast ingots 17 can be made simultaneously (see also FIG. 8).

The strand-casting mold 16 has a single but very much larger mold cavity 16*a* for the production of a single, correspondingly thicker ingot 18 (FIG. 7).

Underneath each mold 15 and 16 there is disposed a vacuum valve 19 and 20, respectively, which is fastened to its corresponding mold. Through the additional vacuum valves 21 and 22, respectively, offbearing chambers 23 and 24 are connected to the two molds 15 and 16, and in each there is disposed an offbearing device 25–26 in the form of a piston rod connected to a hydraulic drive which is not shown. The vacuum valves 21 and 22 are fixedly joined to their corresponding offbearing chambers 23 and 24. After the ingots 17 and 18 have been lowered to the position shown, the vacuum valves 19–21 and 20–22 can be closed, and the related valves can be separated from one another so that the offbearing chamber 23 or 24 related to one or the other mold that is no longer in the melting position can be shifted away laterally and brought into the position 23′ represented in broken lines. In this position the finished ingot or ingots can be completely cooled off and, after opening the vacuum valve 21′, can be removed from the offbearing chamber 23′.

The vacuum valves 21 and 22 are not absolutely necessary. It is possible, for example, to leave the offbearing chambers 23 and 24 constantly connected to the corresponding molds and to remove the finished ingots through side doors (here not represented). Vacuum valves 19 and 20, however, are essential to sustaining the vacuum in the melting chamber 2.

It can also be seen in FIG. 1 that an additional electron beam gun 7 is disposed above the strand-casting molds 15 and 16 in such a position that even the mold cavity 16*a* that is no longer under the falling stream of metal can be heated. The so-called deflection range of the electron beam 7*a* has three notable positions identified by the broken lines a, b and c. In position a the electron beam 7*a* heats the three spouts 13*b* of the tundish 13 disposed between the charging system 8 and the strand-casting mold 15. In this manner the amount of melt running through each spout can be precisely controlled or completely stopped when, for example, a change of molds is to take place. In this case the melt is momentarily "frozen" in the spouts by the reduction of the output, while the level of metal in the tundish 13 slightly increases for a short period of time. This possibility is provided only by the invention, for in the case of the long interruptions practiced heretofore the melting has to be interrupted, so that inhomogeneities develop in the composition of the melt, i.e., no ingot is homogeneous over its entire length. This effect is made negligible by the brief interruption made possible according to the invention.

In position b the electron beam 7*a* strikes the molten material that is in mold cavity 15*a*, so that controlled heat maintenance is possible. By constant deflection between positions a and b a controlled distribution of energy can be performed if, for example, controlled dwell times are established individually by a deflection program.

In position c the electron beam 7*a* heats the mold cavity 16*a* of mold 16 that is in its cooling position. In this manner it is possible to do "hot-topping," or heating the top of the ingot still in the mold, in order thus to prevent voids or other flaws in the top of the ingot. It is evident that, by a programmed control of the electron beam 7*a* with defined dwell times in positions a, b and c, it is possible to perform all of the necessary heating operations with one and the same electron beam gun 7.

In FIG. 2 is shown the alternation of the triple mold 15 in a top view. The molten material carrying means 12 in the form of a tundish 13 is in a fixed location, and the three spouts 13*b* define the direction of fall of the molten metal which runs into the three mold cavities 15*a*. By rotating the chamber bottom, not seen in FIG. 2, the mold 15 can be brought into position 15′, while at the same time mold 16 can be brought to the location of mold 15 if an arrangement in accordance with FIG. 1 is used. FIG. 2 shows, however, that the two molds can be identical, so that three strand-cast ingots 17 can be made with each of the two molds.

FIG. 3 shows that the mold alternation is not limited to rotation about the axis 3. Instead, two molds 15 and 16 can also be interchanged by a linear movement in the direction of the double arrow 27. In the embodiments shown in FIGS. 2 and 3, the points at which the molten metal is poured are fixed due to the fixed mounting of the tundish 13 with the spouts 13*b*.

FIG. 4 shows that, vice versa, it is possible to make the molds 15 and 16 stationary and make the tundish 13 rotatable together with the melting area 14, so that the tundish 13 can be swung from its position on the left (solid lines) to the right-hand position 13′ (broken lines).

With the aid of FIGS. 5 and 6 two additional embodiments are shown which have fixedly disposed molds 15 and 16 in which the shifting of the spout is produced by a linear movement of the tundish 13. In the embodiment in FIG. 5 the tundish 13 is shifted in the direction of its longer axis from the one mold 15 to the other mold 16. In the embodiment in FIG. 6, the tundish 13 is shifted transversely of its longer axis from one mold 15 to the other mold 16.

The configuration of the melt carrying unit 12 as a tundish 13 offers the great advantage that any additional refinement of the melt by vaporizing undesirable components and driving off gases can be performed in the tundish, as well as "gravity refinement" by settling out impurities on the bottom of the tundish and by floating lighter impurities to the surface as slag. On the other hand the use of a tundish 13 is very critical in regard to the loss of volatile elements through evaporation, so that it is necessary to strive for the shortest possible interruption of operation, i.e., by using the mold changing according to the invention, combined with the fastest possible shifting of the position of the pouring point of the melt relative to the mold that is in use.

The following details of the offbearing devices 25 and 26 will also be explained with reference to FIGS. 7 and 8. In the simultaneous production of three individual, relatively slender strand-cast ingots 17 it is especially advantageous to the individual control of the speed of the offbearing of the ingots from the mold 15 if the offbearing device 25 consists of three piston rods which can be operated independently of one another. The control of the speed of movement of each individual piston rod is accomplished in this case by monitoring the level of the melt within the strand-casting mold 15, by a method known in itself.

If, however, a strand-cast ingot 18 with a larger ingot cross section is to be made by means of the mold 16, it is desirable to couple the piston rods of the offbearing device 26 fixedly with one another, which is accomplished in an especially simple manner by means of a mold bottom 27 which is needed anyway at the start of the melting process because the mold cavity 16*a* has to be shut off at the bottom at the beginning of the melting operation.

It can also be understood from FIGS. 7 and 8 that in this case only one vacuum valve 19 and 20 is provided in each case between the molds 15 and 16 and their offbearing chambers. In such a case the removal of the ingots can be performed through a door (not shown) in one side wall of the offbearing chambers 23 and 24.

We claim:

1. Melting furnace for producing strand-cast ingots in a protective gas atmosphere comprising:

a charging system for feeding starting material into a melting area within a melting chamber provided with a chamber floor;

at least one energy source for melting the starting material;

a first strand-casting mold for the conversion of the melt to an ingot;

an ingot offbearing apparatus disposed underneath the strand-casting mold and having an offbearing chamber enveloping the ingot and the offbearing apparatus and associated with the strand-casting mold;

at least one additional strand-casting mold, the first strand-casting mold together with said at least one additional strand-casting mold being disposed in the chamber floor such that each of the strand-casting molds can be brought by a movement relative to the melting area into the drop path of the melt;

an offbearing chamber which can be coupled gas-tight to each strand-casting mold and which has an offbearing apparatus for the ingot; and at least one vacuum valve between each strand-casting mold and the offbearing chamber associated with it.

2. Melting furnace according to claim 1, in which the chamber floor with the at least two strand-casting molds is disposed for movement in a horizontal plane relative to the melting chamber in a gas-tight manner such that one strand-casting mold can be brought at a time into the drop path of the melt, and each of the offbearing chambers is movable together with the corresponding strand-casting mold in a state when coupled to the latter.

3. Melting furnace according to claim 1, which includes, between the melting area and the strand-casting molds, melt carrying means disposed whereby the drop path of the melt can be brought into alignment with each of the strand-casting molds.

4. Melting furnace according to claim 3, in which the melt-carrying means comprises a heatable tundish.

5. Melting furnace according to claim 2, in which the chamber floor is in the form of a rotating disk with a vertical axis of rotation.

6. Melting furnace according to claim 5, which includes on the outer circumference of the chamber floor a ring flange and on the bottom of the melting chamber a corresponding counterflange, said ring flange being joined vacuum-tight but rotatably to the corresponding counterflange on the bottom of the melting chamber.

7. Melting furnace according to claim 1, in which the vacuum valves are constantly joined to the bottom of the strand-casting molds.

8. Melting furnace according to claim 7, which includes between each vacuum valve on the corresponding strand-casting mold and the corresponding offbearing chamber, in each case an additional vacuum valve constantly connected to the corresponding offbearing chamber.

9. Melting furnace according to claim 7, in which each offbearing chamber is disposed underneath the strand-casting mold associated with it so as to be turned laterally away.

10. Melting furnace according to claim 1, in which the at least one strand-casting mold has a plurality of mold cavities for the simultaneous production of a like number of ingots within the same offbearing chamber.

11. Melting furnace according to claim 10, which includes independently drivable offbearing devices associated with the mold cavities of the same strandcasting mold.

12. Melting furnace according to claim 11, in which the offbearing apparatuses associated with each single strand-casting mold are fixably couplable to one another.

13. Melting furnace according to claim 11, in which at least one energy source is an electron beam gun.

14. Melting furnace according to claim 13, which includes a charging apparatus for feeding starting material to the melting chamber, the charging apparatus being disposed in a side wall of the melting chamber and which includes an electron beam gun disposed over the charging apparatus for the melting of the starting material.

15. Melting furnace according to claim 14, which includes at least one additional electron beam gun disposed above the strand-casting molds in such a position that even at least one mold cavity of a strandcasting mold that is longer in the drop path of the melt is heatable.

16. Melting furnace according to claim 1, in which the drop path of the melt is defined by at least one spout of a tundish disposed between the charging apparatus and a strand-casting mold.

* * * * *